United States Patent [19]

Donofrio et al.

[11] Patent Number: 4,618,206

[45] Date of Patent: Oct. 21, 1986

[54] CATHODE RAY TUBE BASE

[75] Inventors: Robert L. Donofrio, Elbridge; Peter G. Puhak, Seneca Falls, both of N.Y.

[73] Assignee: North American Philips Consumer Electronics Corp., New York, N.Y.

[21] Appl. No.: 250,999

[22] Filed: Apr. 3, 1981

[51] Int. Cl.[4] ..... H01R 33/74

[52] U.S. Cl. ..... 339/144 T

[58] Field of Search ..... 339/111, 143 T, 144 T, 339/145 T, 193 N; 313/318

[56] References Cited

U.S. PATENT DOCUMENTS 4,076,366 2/1978 Wardell, Jr. et al. ..... 339/144 T 4,127,313 11/1978 Marks ..... 339/144 T 4,211,465 7/1980 Pultak et al. ..... 339/144 T 4,334,731 6/1982 Amin et al. ..... 339/144 T

*Primary Examiner*—Mark Rosebaum

*Attorney, Agent, or Firm*—John C. Fox

[57] ABSTRACT

The invention provides means for achieving improved adherence between the terminal closure portion of a cathode ray tube and its associated base member. The improvement relates to the forming of a circular array of discretely fashioned spatially related indents or pocket-like reservoirs in the flange portion of the base member. These indents accommodate the advantageous deposition of additional dielectric adhesive in the peripheral region of the flange to realize the desired tube-to-base adherence.

6 Claims, 4 Drawing Figures

CATHODE RAY TUBE BASE

TECHNICAL FIELD

This invention relates to a cathode ray tube (CRT) base and more particularly to structural means incorporated into the base member, such being in the form of a plurality of indents recessed into the surface thereof to provide a plurality of dielectric adhesive anchoring positions for subsequently effecting improved adherence of the base to the respective tube closure portion mated therewith.

BACKGROUND ART

In many state-of-the-art cathode ray tubes, such as those employed in television and allied display applications, technological advancement has resulted in the development of efficient compacted electron gun structures encompassed within small diametered envelope neck portions. The required operating voltages for the various elements comprising these guns are supplied via a plurality of hermetically sealed connective leads or pins traversing and protruding from the integral size-related closure portion. These pins, which are usually oriented in a pin-circle array adjacent to the sealed exhaust tubulation, evidence rather close inter-lead spacings because of the restrictive circumferential arrangement. Since high voltage differentials are existent between certain of the leads, it has been conventional practice to insulate especially the high voltage leads by surrounding them with the adhesive dielectric material utilized to adhere the tube base to the closure portion of the tube.

An exemplary tube base is one fabricated of a plastic material formed to have an axial hollow thimble-like crown portion dimensioned to protectively encompass the sealed tubulation. Extending outwardly from the crown portion, in a shelf-like manner normal thereto, is a flange portion having a diameter in keeping with that of the tube closure portion. This flange, which exhibits a perimetrical rim upon which the closure portion is seated, is traversed by a plurality of apertures arranged in a circular array to accommodate the protruding connective pins of the tube. A minor arcuate section of the flange, whereat the apertures accommodating the high voltage pins are located, evidences a discrete areal surface indentation or recess. It is within this recess that a major portion of the dielectric adhesive is deposited to achieve the requisite adherence of the base to the tube, while simultaneously effecting the desired insulation for the respective high voltage pins. Due to the compact dimensioning between the surface of the base flange and the adjacent closure surface, only a small amount of adhesive can be applied in the restricted spacing therebetween. Thus, the major base-to-tube adherence factor is achieved conjunctively by the limited area of indentation disposed adhesive and the interaction of the pins in the base apertures.

In usage, the base of the tube is mated with connective socket means associated with the respective image display device. It has been conventional practice to integrate adjustable portions of the tube control circuitry on a subchassis arrangement attached to the socket member into which the base of the tube is fitted. This associated circuitry adds mass to the socket component, which in turn subjects the base-to-tube adherence to twisting and/or pulling stresses. Since the tube proper is independently seated and securely affixed, and the base per se is snugly fitted within the receiving socket (which has flexible leads attached thereto), most stresses resulting from the socket mass are applied to the adhesive bond and pins; such being concentrated mainly in the interfacial region between the base and the tube closure portion. Weakening or failure of the limited deposition of adhesive sometimes allows the base to tilt or shift thereby subjecting the pins to deleterious bending strains resulting in fractures of one or more of the hermetic seals. Thus, the possibility of base-to-tube adherence failure is an important factor relating to the achievement of desired tube quality.

DISCLOSURE OF THE INVENTION

It is therefore an object of the invention to reduce and obviate the aforementioned disadvantages evidenced in the prior art. Another object of the invention is the provision of means for effecting improved adherence of a base member to a CRT closure portion.

These and other objects and advantages are accomplished in one aspect of the invention by providing a plurality of individual indents or reservoirs formed in the surface of the base flange portion. These spaced-apart indents accommodate additional dielectric adhesive in excess of that disposed in an areal recessed region of the flange whereat high voltage pins are oriented. The indents which are formed into the flange, in the region between the array of pin-receiving apertures and the perimetrical rim, provide a plurality of adhesive anchoring positions to effect improved adherence of the base to the tube.

BEST MODE FOR CARRYING OUT THE INVENTION

For a better understanding of the present invention together with other and further objects, advantages and capabilities thereof, reference is made to the following disclosure and appended claims taken in conjunction with the aforedescribed drawings.

Figure 1:
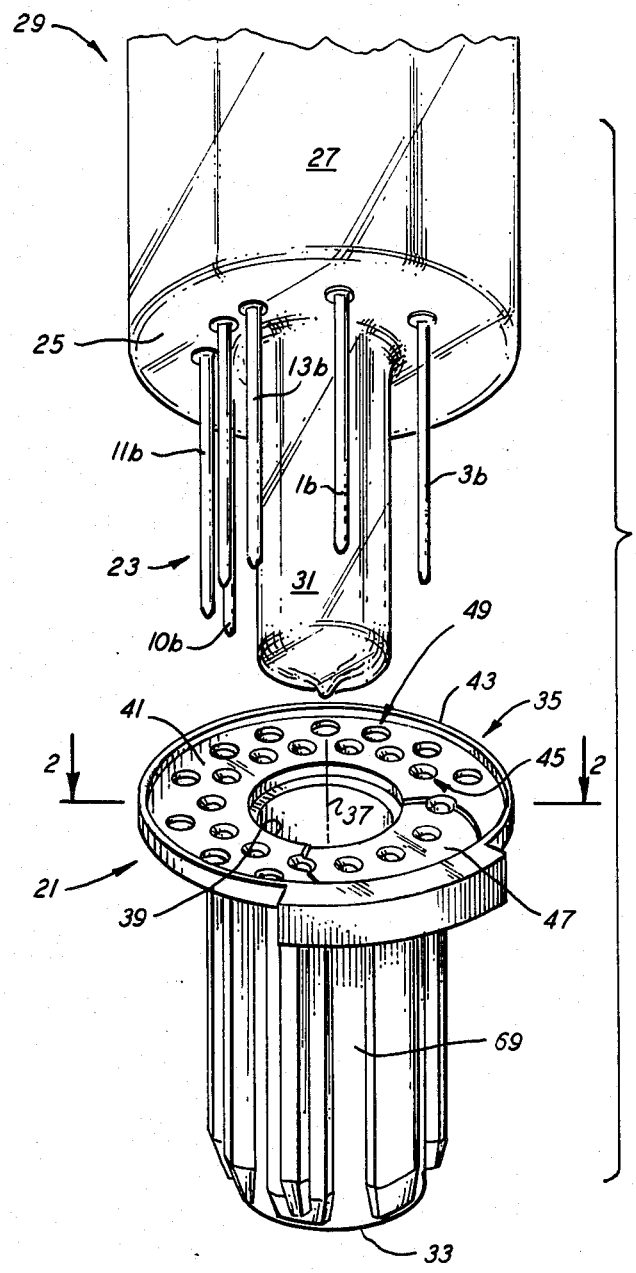
FIG. 1 is an exploded perspective view illustrating the relationship of the improved base with the associated closure portion of a cathode ray tube.

With reference to the drawings, there is shown in FIG. 1 an exploded presentation wherein the improved CRT base 21 is positioned to receive the annular array of connector pins 23 protruding from the terminal closure or header portion 25 of the CRT neck section 27 of the tube 29.

Figure 2:
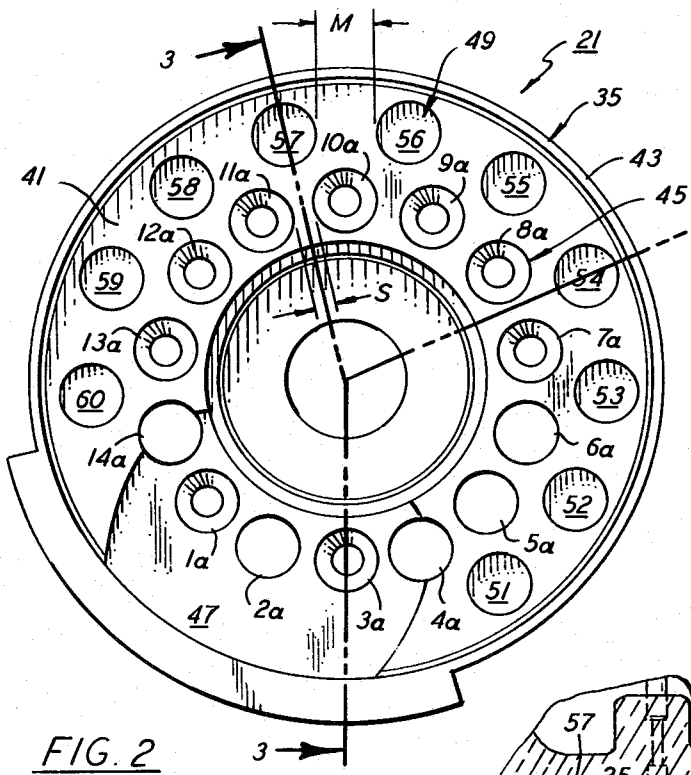
FIG. 2 is a plan view of the top surface of the improved base taken along the line 2—2 of FIG. 1 showing orientation of the indent reservoirs.

Referring to FIGS. 1 and 2 of the drawings in greater detail, the tube terminal closure portion 25 is formed of a hermetically sealed glass header traversed by a circular array of spaced-apart connecting pins 23 which individually project therefrom in parallel relationship with an adjacent axially oriented sealed exhaust tubulation 31.

A mating base 21, fabricated of an insulative plastic material, has a central open-end cylindrical wall fashioned to form an axial hollow thimble-like crown portion 33 dimensioned to spatially encompass the sealed tubulation 31. An annular flange portion 35, having an axis 37, is formed to extend outward from the wall defining the open end 39 of the crown portion 33 in a manner normal thereto. The flange portion is of a diameter in keeping with that of the tube closure portion 25, and evidences an upper or interfacial surface 41, such being circumferentially bounded by a low upstanding perimetrical rim 43 which provides seating means for the peripheral region of the tube closure portion 25.

The interfacial surface 41 of the flange, being adjacent to the closure portion when the base is positioned on the tube, is demarcated by a circular array of spaced pin positioning stations 45 oriented about and adjacent to the crown portion 3. In the exemplary base detailed in this instance, the pin positioning stations are numbered from 1*a* through 14*a*, whereof positions 1*a*, 3*a*, 7*a*, 8*a*, 9*a*, 10*a*, 11*a*, 12*a* and 13*a* have apertures traversing the flange portion 35 to accommodate a similarly-numbered mating pin arrangement 23 extending from the closure portion. Mating pins 1*b*, 3*b*, 10*b*, 11*b*, and 13*b* are shown in FIG. 1, while the remaining mating ends are located behind exhaust tubulation 31. As noted, the flange portion evidences an areal indentation 47 wherein pin receiving apertures 1*a* and 3*a* are located.

The invention relates to an improvement incorporated into the structure of the base, such being in the form of a substantially circular array of spaced-apart indents 49, set inward from the interfacial surface 41 in the region of the flange portion 35 between the perimetrical rim 43 and the array of pin stations 45 not occupied by the aforementioned areal indentation 47. These indents provide a plurality of advantageous reservoirs wherein additional adhesive is disposed thereby furnishing a number of anchoring positions to effect improved adherence when the base is affixed to the tube. In the example illustrated, ten indents are shown being denoted as 51 through 60. They are substantially equally spaced apart in the array wherein the end indents 51 and 60 are substantially equally spaced from the areal indentation 47. The spacing "M" between adjacent indents affords sufficient material mass to assure structural rigidity for the base. As is evident, a lesser number of indents can be utilized; in any case not less that two, 54 and 58 for example, where with indentation 47, a minimum but stabilized tri-point anchoring means would be effected. But, to achieve and assure maximum adherence, it is advantageous to form and utilize as many indents as possible.

Figure 3:
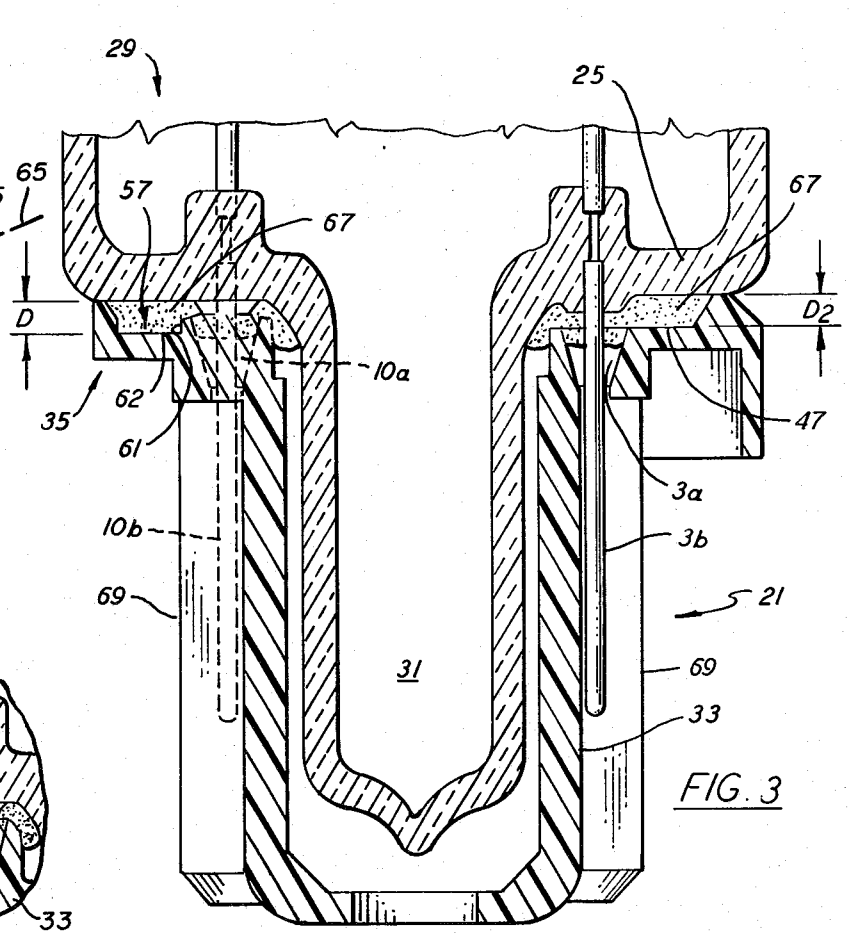
FIG. 3 is a sectioned elevational view taken along section line 3—3 of FIG. 2, illustrating the mating of the tube closure portion with the improved base.
Figure 4:
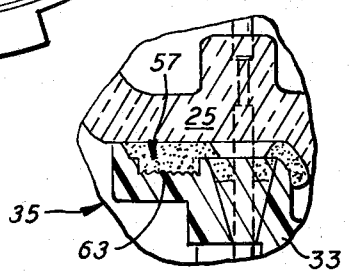
FIG. 4 is a fragmented sectional elevation of portions of the tube and base illustrating a modification of the indent structure.

In referring to FIGS. 2, 3 and 4, the indents are formed as substantially round shapings with defined sidewalls 61 and bottoms that are substantially flat 62 as shown for indent 57 in FIG. 3; or the bottoms may be substantially roughened 63 to augment adherence, as indicated in FIG. 4. Each of the indents has a depth "D", that is substantially equal to the depth "$D_2$" of the areal indentation 47 to accommodate maximum depositions of dielectric adhesive.

As delineated in FIG. 2, each of the indents is individually centered on a separate radius, such as 65, extending from the axis 37 of the flange portion 35. Each radius is oriented to bisect the spatial distance "S" separating two adjacent pin positioning stations, as for example, 10*a* and 11*a*.

When the base is to be affixed to the tube, the dielectric adhesive is applied as a circularly disposed band or beading in a manner to fill the areal indentation and each of the respective indents. Then, the tube closure portion 25 is mated with the base 21, as shown in FIG. 3, wherein one of the high voltage tube connective pins 3*b* traverses the base flange portion through the aperture in pin position 3*a*, while another pin 10*b* is accommodated through the aperture in pin position 10*a*. The respective pins thence slide into and are protected by individual longitudinal U-shaped channels, such as 69, formed on the exterior of the base thimble portion 33. These, in turn, mate with compatible structures in a tube-receiving socket, not shown. As the closure portion 25 seats in the rim 43 of the base, the dielectric adhesive 67 is squeezed to substantially fill the intervening space between the closure portion and the interfacial surface of the flange portion, thereby completely filling the indent reservoirs and the areal indentation 47. This provides an expansive configurated deposition of adhesive, the surface uniformity of which resists tilting of the base. Thus, improved base-to-tube adherence and resultant improved tube quality are achieved.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The plurality of indents formed in the flange portion of the CRT base expeditiously provide pocket-like adhesive reservoirs or adherence anchoring positions that are in no way evident in the prior art. The defined sides and bottoms of the discretely located recesses increase surface areal contact and augment the tube-to-base anchoring parameters. The structural aspects of the invention represent means for achieving marked improvement in tube quality.

What is claimed is:

1. An improvement in a cathode ray tube base of the type employing a substantially arcuate application of dielectric adhesive for effecting adherence of said base to the closure portion of a tube wherefrom a sealed exhaust tubulation and a circular array of surrounding connective pins extends in parallel relationship, said base having an axial crown portion dimensioned to spatially encompass said tubulation, said crown portion having an open end and a closed end, an annular flanged portion extending outwardly from the open end of the crown, said flanged portion having an interfacial surface circumferentially bounded by an upstanding perimetrical rim, said interfacial surface and rim adapted for seating with the peripheral region of said tube closure portion, said interfacial surface being demarcated by a circular array of spaced pin positioning stations oriented about and adjacent to said crown portion, the majority of said stations having apertures traversing said flanged portion to accommodate the mating pin arrangement extending from said closure portion, said interfacial surface having a discrete inwardly recessed region wherein at least one of said pin-receiving apertures is oriented, said region extending entirely across the surface from the rim to the crown, said base improvement comprising:

a plurality of spaced-apart indents in the interfacial surface of said flanged portion, said indents located between said perimetrical rim and said array of pin stations in the expanse thereof not occupied by said recessed region, said indents providing a plurality of adhesive anchoring positions for subsequently effecting improved adhesion of said base to said closure portion.

2. The cathode ray tube base according to claim 1 wherein said indents are at least two in number, such being substantially equally spaced from each other and said areal indentation.

3. The cathode ray tube base according to claim 1 wherein said plurality of indents are individually centered on separate radii extending from the axis of said flange portion and bisecting the spatial distance separating two adjacent pin positioning stations.

4. The cathode ray tube base according to claim 1 wherein said indents are approximately bowl-shaped, having round openings in the interfacial surface and substantially flat bottoms.

5. The cathode ray tube base according to claim 1 wherein the bottoms of said indents are substantially roughened to augment adhesive adherence.

6. The cathode ray tube base according to claim 1 wherein the depths of said indents inward from said interfacial surface are substantially equal to the depth of said areal indentation.

* * * * *